US005406665A

United States Patent [19]

Czopek et al.

[11] Patent Number: 5,406,665

[45] Date of Patent: Apr. 18, 1995

[54] PNEUMATIC MECHANISM FOR ADJUSTING A GLASS SHEET WASHING MACHINE

[75] Inventors: John A. Czopek, Western Springs; Jacob Vaynerman, Naperville; Ronald N. Ford, Lockport, all of Ill.

[73] Assignee: Sommer & Maca Industries, Inc., Chicago, Ill.

[21] Appl. No.: 186,125

[22] Filed: Jan. 25, 1994

[51] Int. Cl.[6] ..... B08B 11/04; A46B 13/02

[52] U.S. Cl. ..... 15/77; 15/102; 100/170

[58] Field of Search ..... 15/77, 102; 100/170

[56] References Cited

U.S. PATENT DOCUMENTS 2,199,135 4/1940 Johnson ..... 15/77
3,449,781 6/1969 French et al. ..... 15/77
3,896,924 7/1975 Sbarra ..... 15/77

*Primary Examiner*—Edward L. Roberts, Jr.
*Attorney, Agent, or Firm*—Dorn, McEachran, Jambor & Keating

[57] ABSTRACT

A pneumatic mechanism for incrementally adjusting a glass sheet washing machine of the type having upper and lower sets of brushes and rollers spaced apart vertically to wash sheets of glass of various thicknesses passing between the sets. The upper set of brushes and rollers is carried by an upper frame member and the lower set of brushes and rollers is carried by a lower frame member. The pneumatic mechanism includes a pair of stacked pneumatic cylinders arranged in lifting engagement with the upper frame member at each corner of the upper frame. A selector is provided to sequentially actuate one and then the other of the pneumatic cylinders in a stack to extend their piston rods which are of different lengths to raise the upper frame relative to the lower frame by incremental distances defined by the extended lengths of the respective piston rods.

3 Claims, 4 Drawing Sheets

PNEUMATIC MECHANISM FOR ADJUSTING A GLASS SHEET WASHING MACHINE

BACKGROUND AND SUMMARY OF THE INVENTION

This invention is directed to a flat glass washing machine which can be rapidly adjusted to enable it to handle different thicknesses of glass. Conventional flat glass washing machines have upper and lower frames which carry aligned sets of brushes and rollers. These machines also have water/detergent piping and spray nozzles for applying washing solution to the sheets of glass and air blast tubes to remove the washing solution and dry the glass. These machines are initially set to handle glass sheets of a minimum thickness which pass between the sets of brushes and rollers. The upper frame is usually manually adjustable relative to the lower frame to permit the sets of brushes and rollers to accommodate glass of greater thickness. Some of these conventional glass washing machines have the upper frame pivotally mounted on the lower frame so that it can be tilted upwardly relative to the lower frame for ease of cleaning and maintenance of the sets of brushes and rollers. However, these conventional machines generally are manually adjustable to clean glass sheets of varying thicknesses.

An object of this invention is a flat glass washing machine having a pneumatic actuated mechanism for rapidly raising its upper frame through several preselected distances to enable it to handle different thicknesses of glass.

Another object of this invention is a flat glass washing machine having a pneumatic actuated mechanism for rapidly adjusting a pivotally mounted upper frame to handle glass of different thicknesses.

Yet another object of this invention is a flat glass washing machine having a pneumatically actuated adjustment mechanism which allows the selection and rapid adjustment of the machine to handle glass in three different ranges of thickness.

Other objects may be found in the following specification, claims and drawings.

BRIEF DESCRIPTION OF THE DRAWINGS

The invention is illustrated both schematically and somewhat diagrammatically in the following drawings wherein.

DESCRIPTION OF THE PREFERRED EMBODIMENT

Figure 1:
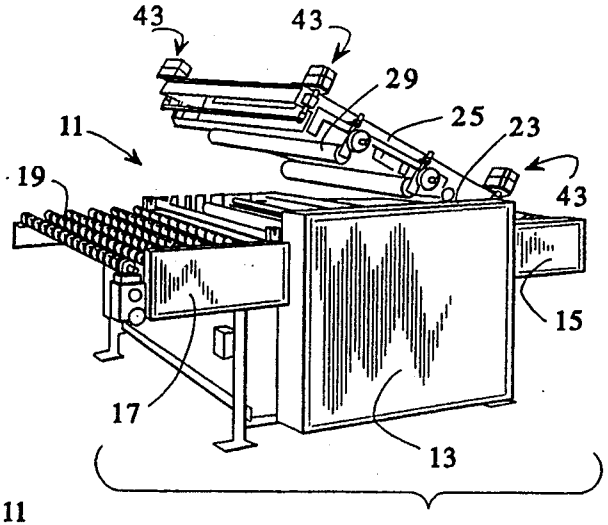
FIG. 1 is a perspective view of a flat glass washing machine of the type having a tiltably mounted upper frame and embodying the novel features of this invention.

FIG. 1 of the drawings shows a flat glass washing machine 11 embodying the novel features of this invention. As is conventional, the flat glass washing machine includes a housing 13 having an entrance conveyor 15 and an exit conveyor 17 for the glass. These conveyors are formed of rubber ring rolls 19. The machine further includes a lower fixed frame 23 mounted on the housing 13 and an upper frame 25 which is pivotally mounted on the lower frame and is adjustable vertically relative to the lower frame. The glass washing machine, as is conventional, includes solid rubber pinch feed rolls which are mounted on the upper and lower frames in alignment with each other, washing solution piping, and spray nozzles and air blast drying tubes which are not shown in the drawings for clarity of illustration. Sets of spiral wound washing brushes 29 are also mounted on the upper and lower frames in alignment with each other to engage the glass passing there between.

Figure 2:
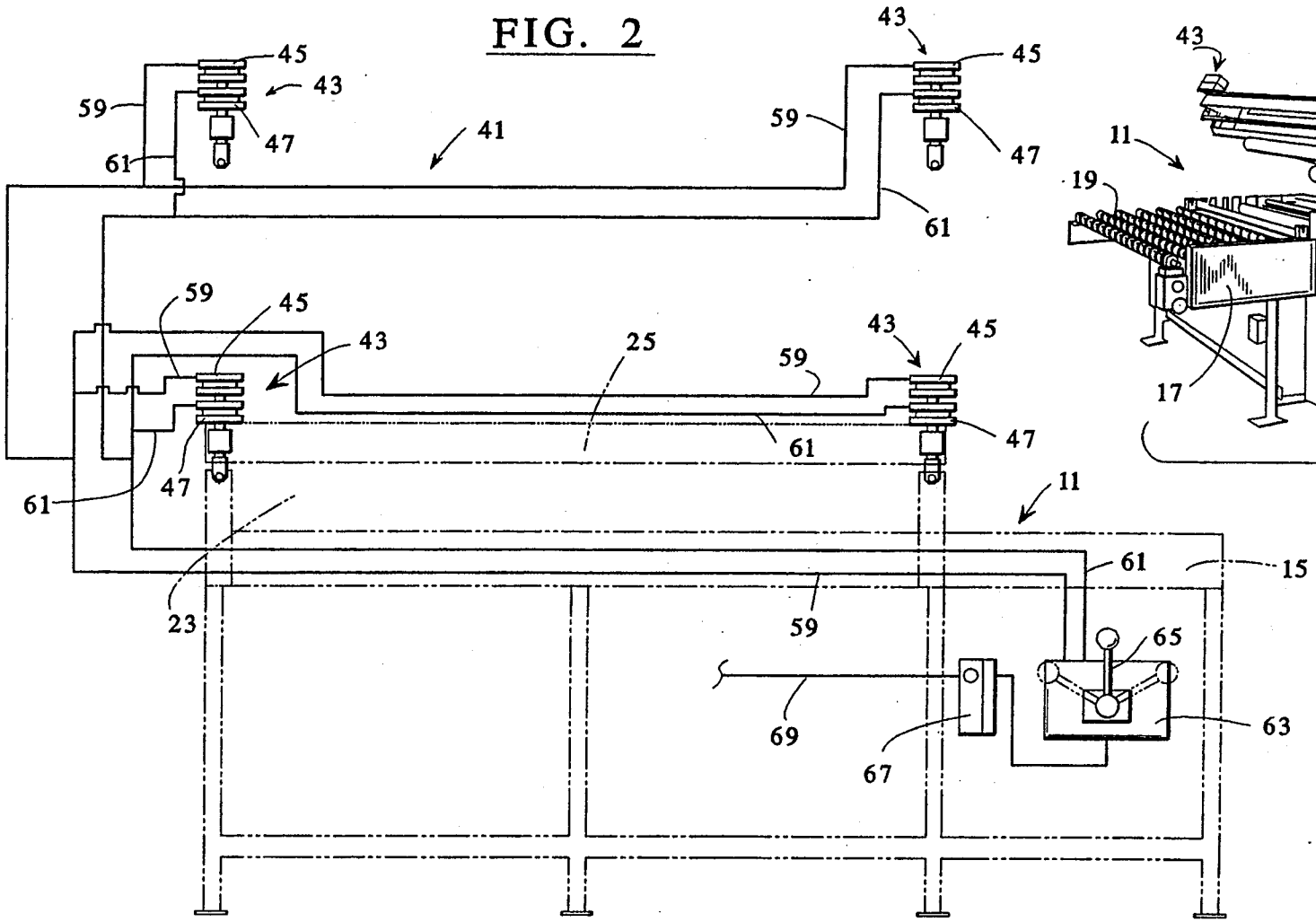
FIG. 2 is a somewhat schematic and diagrammatic view of the pneumatic cylinders, air supply conduits and selector valve for the upper frame adjustment mechanism of this invention mounted on a flat glass washing machine, only a portion of which is shown in phantom lines for clarity of illustration.
Figure 3:
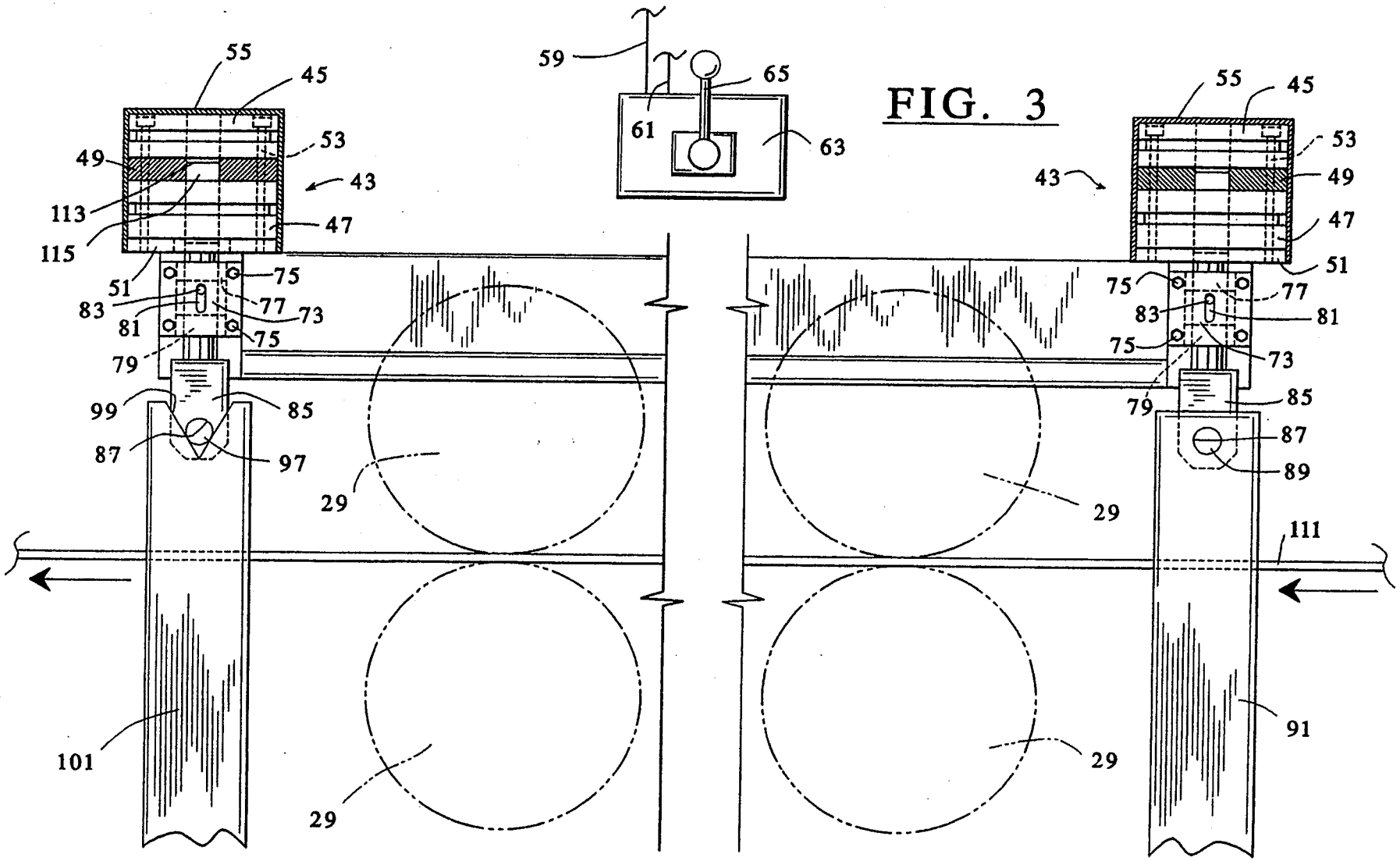
FIG. 3 is an elevational schematic view of a portion of a glass washing machine embodying the novel features of this invention with parts broken away and other parts shown in cross section and in phantom lines for clarity of illustration and showing the upper frame in its position of adjustment to handle glass of minimum thickness.
Figure 4:
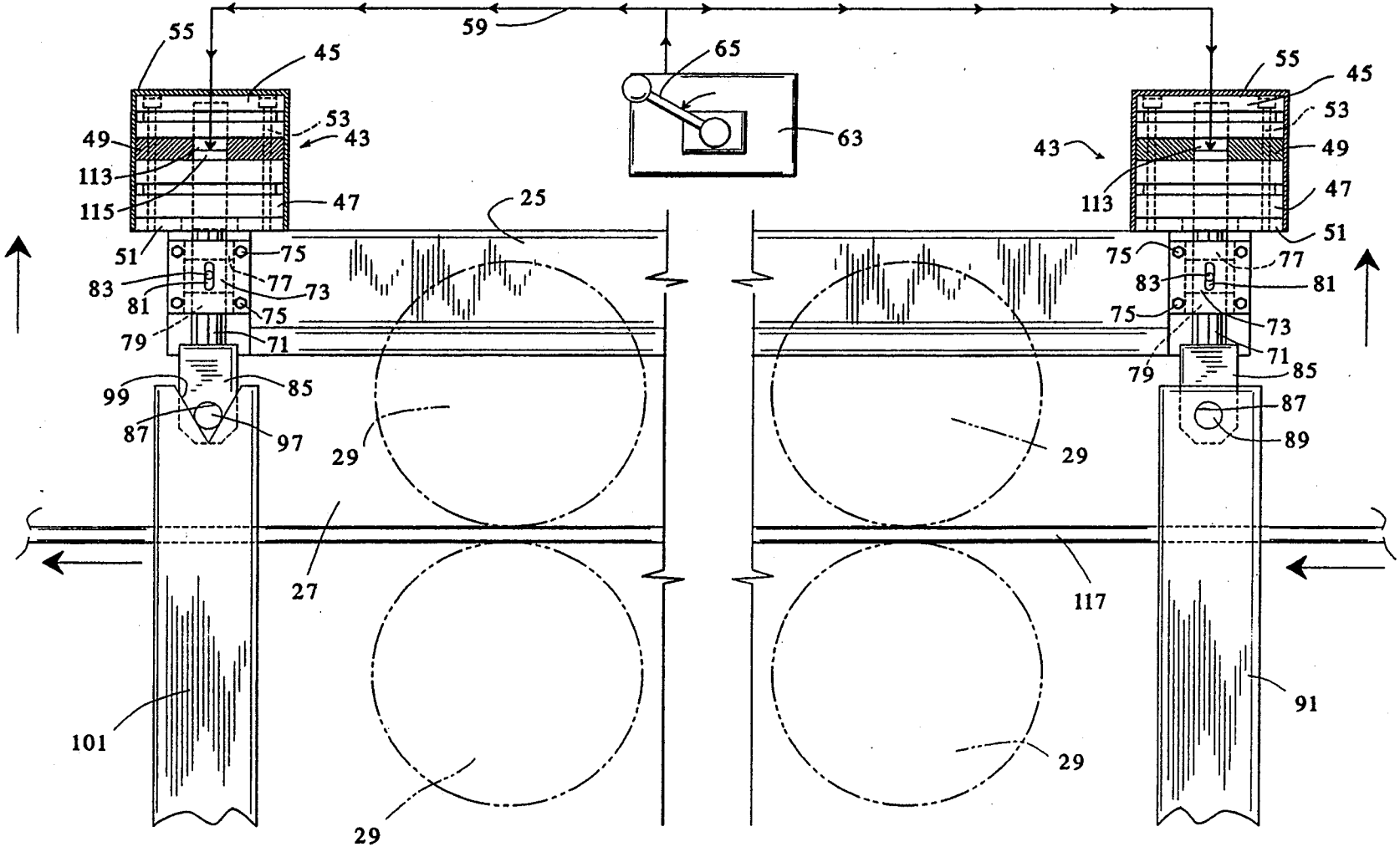
FIG. 4 is a view similar to that of FIG. 3 but showing the upper frame of the glass washing machine adjusted to handle glass of intermediate thickness.
Figure 5:
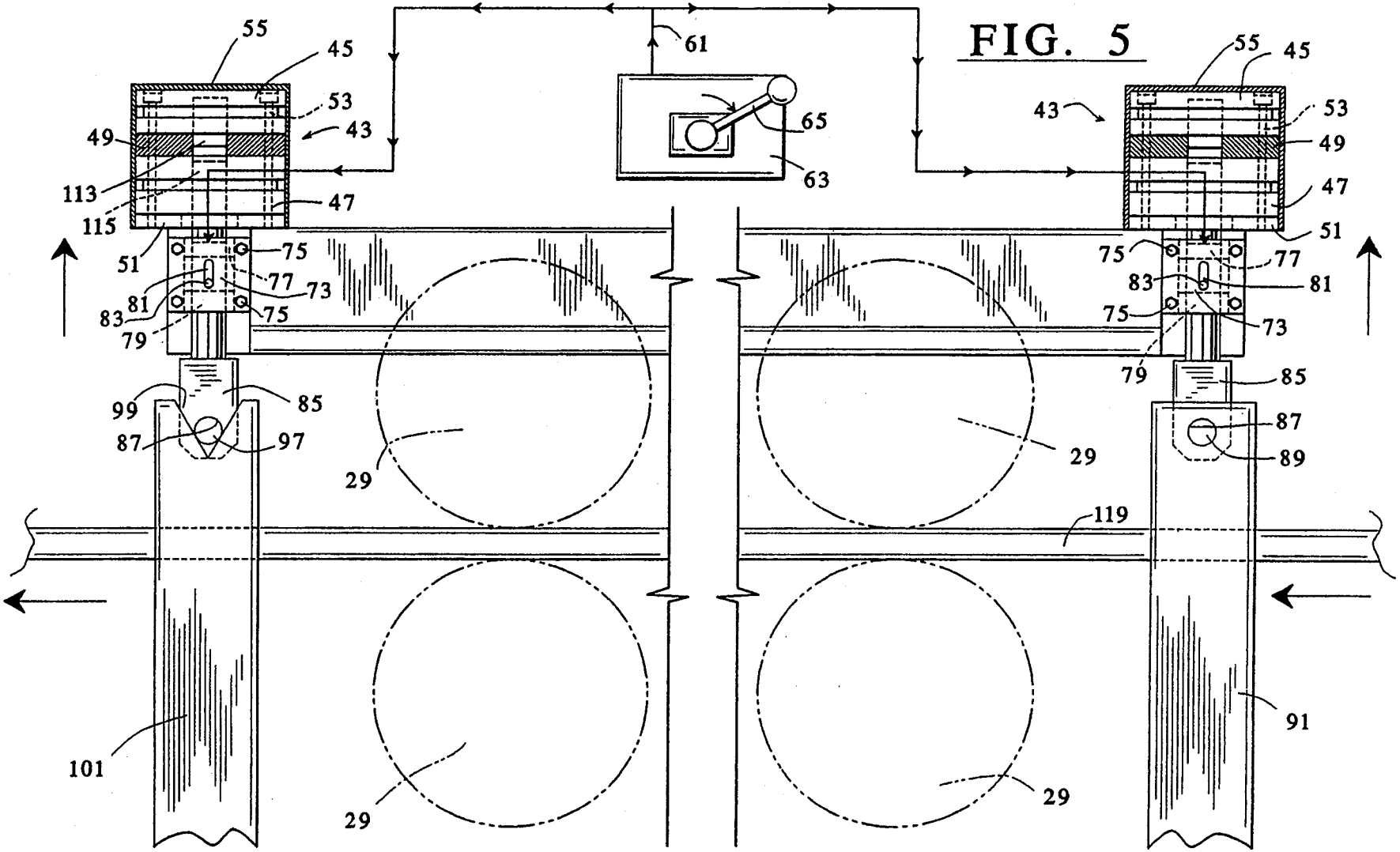
FIG. 5 is a view similar to that of FIG. 3 but showing the upper frame adjusted to handle glass of maximum thickness.

A pneumatic adjustment system 41 for raising the upper frame 25 relative to the lower frame 23 in predetermined increments is shown schematically in FIG. 2 of the drawings and in more detail in FIGS. 3, 4 and 5 thereof. This system includes stacks 43 of air cylinders unmounted on the top of each corner of the upper frame 25. Each stack of cylinders including an upper cylinder 45 and a lower cylinder 47. Ring spacers 49 shown in FIGS. 3–5 of the drawings are located between the upper and lower cylinders. The cylinders 45 and 47 are mounted on and fastened to support plates 51 which are bolted to the corners of the upper frame. The stacks of cylinders are attached to the support plates by bolts 53. A protective cover 55 is provided for each stack 43 of cylinders and these covers are shown in FIGS. 1 and 3–5 of the drawings.

Compressed air for use in the pneumatic adjustment system is supplied to the upper cylinders through conduits 59 and to the lower cylinders through conduits 61. As shown most clearly in FIG. 2 of the drawings, these conduits lead to a manually operated selector valve 63 which is a three position valve operated by a handle 65. Air is supplied to this valve through a pressure regulator valve 67 which is fed by a conduit 69 leading to a shop air supply.

The upper frame 25 is slidably mounted for vertical movement relative to the lower frame 23 on four corner posts 71 which are received in tubular housings 73 affixed to the upper frame by fasteners 75. Each corner post extends through two spaced apart bushings 77 and 79 located in a tubular housing 73 as shown in detail in FIGS. 3–5 of the drawings. An elongated slot 81 is cut through each tubular housing at a location between the bushings. A guide pin 83 attached to each corner post 71 extends through an elongated slot 81 to limit vertical movement of each corner post relative to its tubular housing.

A plate 85 is fastened to a bottom of each corner post 71 and a circular opening 87 is formed in each plate near the lower end thereof. The openings 87 in the plates 85 of the corner posts 71 at the upstream entrance to the glass washing machine receive axles 89 which are journaled in upright posts 91 of the housing frame. This arrangement provides the pivoting mounting for the upper frame 25 relative to the lower frame 23. A cross bar 97 is seated in the openings 87 in the plates 85 which are part of the corner posts 71 at the exit end of the glass washing machine 11. This cross bar seats in upwardly opening V-shaped slots 99 formed in upright posts 101 which are part of the glass washing machine structure and located at the exit end of the glass washing machine housing 13. The cross-bar seats in the V-shaped slots 99 to limit downwardly pivotal rotation of the upper frame 25 about its pivot mounting to maintain the upper frame in a parallel relationship to the lower frame.

When the handle 65 of the selector valve 63 of the pneumatic adjustment system is in its vertical position shown in solid line in FIGS. 2 and 3 of the drawings, the pneumatic adjustment system is inactive and the upper frame 25 is located at its lowest position relative to the lower frame as shown in FIG. 3 of the drawings. In this position of adjustment, the washing machine is adapted to accept single thickness glass 111 (approximately 0.050 inches thick) and other glass up to one-quarter inch in thickness as shown in FIG. 3 of the drawings.

When the operating handle 65 of the selection valve 63 is rotated in a counterclockwise direction to the position shown in FIG. 4 of the drawings, the air supply is directed to conduit 59 which actuates the upper cylinders 45 of the stacks 43 of air cylinders. This action extends the piston rods 113 of the cylinders 45 through their strokes of approximately one-quarter inch. The upper and lower air cylinders 45 and 47 are stacked. The piston rod 113 of each upper air cylinder 45 engages the piston rod 115 of each lower cylinder 47. The piston rod 115 of each lower air cylinder extends through its upper and lower surfaces to engage the upper surface of the corner posts 71 to thereby raise the upper frame 25 of the glass washing machine relative to the lower frame 27. This adjustment permits the washing machine to accept a sheet 117 of glass having a thickness from one-quarter to one-half inch.

In order to adjust the upper frame 25 relative to the lower frame 27 to accept ½ inch glass up to ¾ inch glass, the handle 65 of the selector valve 63 is moved in a clockwise direction to its position shown in FIG. 5 of the drawings. When in this position, the selector valve 63 disconnects the shop air from the upper cylinders 45 and directs air through the conduits 61 to the lower cylinders 47 of the stacks of cylinders 43. The application of air to the lower cylinders 47 extends the piston rods 115 of the lower cylinders through their full one-half inch strokes to lift the upper frame 25 relative to the lower frame 27 to enable the glass washing machine to accept glass 119 having a thickness from one-half inch to three-quarters inch.

The pneumatic arrangement 45 may also be modified to provide only the smaller upper pneumatic cylinders 41 which have a one-quarter inch piston rod stroke so that the total adjustment of the glass washing machine would range from single thickness to one-half inch glass. This would require the replacement of the three position selector valve 63 with a two position selector valve which would provide an either "on" "off" operation but this modification is not shown in the drawings.

We claim:

1. A pneumatic mechanism for incrementally adjusting a glass sheet washing machine of the type having upper and lower sets of brushes and rollers spaced apart vertically to wash a sheet of glass passing between said sets of brushes and rollers, said upper set of brushes and rollers being carried by an upper frame member and said lower set of brushes and rollers being carried by a lower frame member, said pneumatic mechanism including:

means to mount said upper frame member for vertical movement relative to said lower frame member, at least one pair of stacked pneumatic cylinders mounted on said upper frame member with each of said pair of stacked cylinders having an extendable piston rod mounted for lifting said upper frame upon energization of one of said pneumatic cylinders and extension of its piston rod, each of said extendible piston rods arranged for lifting engagement with said upper frame member mounting means upon extension of said piston rod, means to selectively energize one or the other of said pneumatic cylinders to extend its piston rod to raise said upper frame relative to said lower frame through an incremental distance equal to the extended length of said extended piston rod.

2. The pneumatic mechanism of claim 1 in which a pair of stacked pneumatic cylinders including upper and lower cylinders are installed at each corner of said upper frame member with each of said pairs of stacked pneumatic cylinders arranged in lifting engagement with said upper frame member, and means to selectively energize either all of said upper cylinders or all of said lower cylinders of said stacks of cylinders to extend their piston rods to raise said upper frame relative to said lower frame by an incremental distance defined by the extended length of a piston rod, said upper cylinders having piston rods with extended lengths different than the extended lengths of the piston rods of the lower cylinders.

3. A pneumatic mechanism for incrementally adjusting a glass sheet washing machine of the type having upper and lower sets of brushes and rollers spaced apart vertically to wash a sheet of glass passing between said sets of brushes and rollers, said upper set of brushes and rollers being carried by an upper rectangular frame member and said lower set of brushes and rollers being carried by a lower rectangular frame member, said pneumatic mechanism including:

means to mount said upper frame member for vertical movement relative to said lower frame member on supporting posts, a pair of stacked upper and lower pneumatic cylinders mounted at each corner of said upper rectangular frame member in lifting engagement with said upper rectangular frame member, said upper pneumatic cylinders having piston rods which, when extended, push against piston rods of said lower cylinders, said lower pneumatic cylinders having piston rods which engage and push against the tops of said supporting posts, said upper pneumatic cylinders having piston rods which are extendable for different lengths than the piston rods of said lower pneumatic cylinders, and means to selectively energize all of the upper or all of the lower pneumatic cylinders to extend their respective piston rods to raise said upper rectangular frame member relative to said lower rectangular frame member by an incremental distance defined by the extended lengths of said piston rods.

* * * * *